US008777136B2

(12) United States Patent
Jander

(10) Patent No.: US 8,777,136 B2
(45) Date of Patent: Jul. 15, 2014

(54) CHOPPER FOR COMMINGLED FIBERS

(75) Inventor: Michael Horst Jander, Hjarnarp (SE)

(73) Assignee: OCV Intellectual Capital, LLC, Toledo, OH (US)

( * ) Notice: Subject to any disclaimer, the term of this patent is extended or adjusted under 35 U.S.C. 154(b) by 212 days.

(21) Appl. No.: 13/124,463

(22) PCT Filed: Oct. 22, 2009

(86) PCT No.: PCT/US2009/061569

§ 371 (c)(1),
(2), (4) Date: Aug. 1, 2011

(87) PCT Pub. No.: WO2010/048351

PCT Pub. Date: Apr. 29, 2010

(65) Prior Publication Data

US 2011/0272509 A1 Nov. 10, 2011

(51) Int. Cl.
*B02C 19/00* (2006.01)

(52) U.S. Cl.
USPC ..... 241/30

(58) Field of Classification Search
USPC ..... 241/30, 222
See application file for complete search history.

(56) References Cited

U.S. PATENT DOCUMENTS

| | | | |
|---|---|---|---|
| 4,169,397 | A | 10/1979 | Vehling et al. |
| 5,170,687 | A | 12/1992 | Ratjen et al. |
| 5,806,387 | A | 9/1998 | Jander |
| 5,819,614 | A | 10/1998 | Jander |
| 6,027,059 | A | 2/2000 | Hand |
| 6,038,949 | A | 3/2000 | Jander |

FOREIGN PATENT DOCUMENTS

| | | |
|---|---|---|
| CN | 1188440 | 7/1998 |
| SU | 1694724 | 11/1991 |
| WO | 97/47448 | 12/1997 |
| WO | 00/15526 | 3/2000 |
| WO | 2010/048351 | 4/2010 |

OTHER PUBLICATIONS

Office action from Chinese Application No. 200980147637.0 dated Dec. 4, 2012.
International Search Report and Written Opinion from PCT/US09/61569 dated Apr. 26, 2010.
Notice of Abandonment from U.S. Appl. No. 12/256,034 dated Mar. 5, 2010.
Office action from Saudi Arabian Application No. 109300629 dated Jun. 5, 2013 along with English translation of relevant portions of action.
Office action from European Application No. 09749247.4 dated Mar. 12, 2014.

*Primary Examiner* — Mark Rosenbaum
(74) *Attorney, Agent, or Firm* — Calfee, Halter & Griswold LLP

(57) ABSTRACT

A device for chopping fiber strand includes a form, and a strand feeding mechanism that delivers the strand to the form and conveys the strand along the form. First and second grinding wheels may be included to cut the strand into individual segments of desired length as the strand is conveyed along the form. A method of chopping a fiber strand includes the steps of delivering a continuous strand onto a base end of a form, conveying the continuous strand along the form from the base end toward a discharge end and cutting the continuous strand into individual segments of desired length, for example using first and second grinding wheels.

20 Claims, 7 Drawing Sheets

CHOPPER FOR COMMINGLED FIBERS

RELATED APPLICATIONS

This application is a national phase entry under 35 U.S.C. §371 and claims priority to International Application No. PCT/US2009/61569, with an International Filing Date of Oct. 22, 2009, for CHOPPER FOR COMMINGLED FIBERS, which claims the benefit of U.S. patent application Ser. No. 12/256,034 filed on Oct. 22, 2008, now abandoned, for CHOPPER FOR COMMINGLED FIBERS, the entire disclosures of which are fully incorporated herein by reference.

TECHNICAL FIELD AND INDUSTRIAL APPLICABILITY OF THE INVENTION

The present invention relates generally to the field of chopped fibers and, more particularly, to an apparatus and method for efficiently and effectively chopping a fiber strand into individual fiber segments of desired length which are then promptly dispersed in an orderly fashion.

BACKGROUND OF THE INVENTION

The process of cutting continuous reinforcement fibers into fiber segments of discrete length is useful in the manufacture of different types of reinforcement structures. For example, the discrete length segments of reinforcement fibers can be used in reinforcement mats such as mats made with commingled fibers (e.g., glass fibers commingled with thermoplastic fibers), or laminated mats made from layers of fibers.

The discrete length segments of reinforcement fibers can also be used in reinforcement preforms. Structural composites and other reinforced molded articles are commonly made by resin transfer molding and structural resin injection molding. These molding processes have been made more efficient by preforming the reinforcement fibers into a reinforcement preform which is the approximate shape and size of the molded article, and then inserting the reinforcement preform into the mold.

To be acceptable for production at an industrial level, a fast preforming process is required. In the manufacture of preforms, a common practice is to supply a continuous length of reinforcement strand or fiber to a reinforcement dispenser or "chopper", which cuts the continuous fiber into many fiber segments of discrete length, and deposits the fiber segments onto a collection surface. This process can be used to make preforms in an automated manner by mounting the reinforcement dispenser for movement over the collection surface, and programming the movement of the dispenser to apply the fiber segments in a predetermined, desired pattern.

The reinforcement dispenser can be robotized or automated, and such reinforcement dispensers are known art for such uses as making preforms for large structural parts, as in the auto industry, for example. (Dispensers of reinforcement fibers for the manufacture of mats of commingled fibers or laminated mats can also be adapted to be moveable and programmable.) Typically, the deposited fibers are dusted with a powdered binder, and compressed with a second perforated mold. Hot air and pressure sets the binder, producing a preform of reinforcement fibers which can be stored and shipped to the ultimate molding customer which applies resin to the preform and molds the resinated preform to make a reinforced product, typically using a resin injection process.

As the technical requirements for reinforcement structures increase, new methods for dispensing and laying down reinforcement fibers are required. One requirement is that the reinforcement fibers be delivered at faster speeds than used previously. Another requirement is that the reinforcement fibers be laid down in a predetermined orientation. The advancement in the reinforcement technology enabling a moveable and programmable reinforcement dispenser has led to requirements for very sophisticated fiber patterns and orientations. Reinforcement structures can be designed with specific amounts and orientations of reinforcement fibers to improve the strength of the structure precisely at the weakest or most stressed location of the article to be reinforced. Because of this new sophistication, there often is a requirement that the fibers be laid onto the collecting surface in a closely spaced, parallel arrangement.

U.S. Pat. No. 6,038,949 discloses a state of the art chopping device and method that generally provides the best performance to date. The device forms a strand into a loop that is fed along a form and generally flattened before being cut with rotating knives into individual fiber segments of desired length. While the apparatus and method disclosed in the U.S. Pat. No. 6,038,949 patent generally provide good performance, they suffer from a number of shortcomings and, accordingly, a need exists for an improved chopping device and method. More specifically, when processing a fiber material of a type comprising comingled unidirectional thermoplastic and glass fibers the device disclosed in U.S. Pat. No. 6,038,949 crutches the glass fibers and cuts the thermoplastic fiber. The hard and abrasive glass fiber rapidly wears the rotating knives which dull and then cannot cut the thermoplastic fibers. As a consequence, the knives must often be replaced thereby reducing productivity. In addition, it should be appreciated that the rotating knives have a fairly large diameter and must be placed at least one radius of the knife from the end of the chopping device.

Thus, the chopped fiber segments must be conveyed a significant distance along the device before they can be dispensed. Chopped fibers are difficult to handle and on occasion one or more fiber segments are dislocated, potentially resulting in the fiber being dispensed in an undesired orientation or position.

The present invention relates to an improved chopping device and method that utilizes grinding wheels to cut the fiber. Such grinding wheels have a longer service life than the rotating blades used in the prior art chopper and, accordingly, the present invention reduces maintenance down time and increases productivity. Further, the grinding wheels are positioned adjacent the discharge end of the chopping device so that the individual chopped fiber segments are only handled/conveyed for a very short distance before being dispensed. This substantially reduces the potential for dislocation of the fiber segments and thereby ensures proper, ordered handling of the chopped fiber segments and dispensing in the desired position and orientation.

SUMMARY OF THE INVENTION

In accordance with the purposes of the present invention as described herein, a device is provided for chopping fiber strand. The device comprises a form, a strand feeding mechanism that delivers the strand to the form and conveys the strand along the form and first and second grinding wheels that cut the strand into individual segments of desired length as the strand is conveyed along the form.

The form has a base end, having a generally circular cross section, and a discharge end comprising an elongated linear edge. The form generally tapers and becomes progressively flatter and wider from the base end to the discharge end.

In one possible embodiment, the strand feeding mechanism includes a rotor and a motor to drive that rotor. The rotor includes a feed passage through which the strand is delivered onto and around the form as the rotor is rotated. The strand feeding mechanism further includes a feeder by which the strand is moved along the form from the base end to the discharge end. The feeder includes first and second feed screws. The first feed screw is provided along a first side of the form while the second feed screw is provided on a second, opposite side of the form. In addition, the feeder includes third and fourth feed screws. The third and fourth feed screws are provided along the form at the discharge end. At least a portion of each of the third and fourth feed screws is provided between the first and second feed screws.

Guide plates are provided over the form adjacent the third and fourth feed screws. The guide plates are spring loaded. As a result of that spring loading the guide plates help guide the strand into the third and fourth feed screws and simultaneously bias the strand toward the first and second grinding wheels so as to increase the efficiency of the cutting process.

The first grinding wheel is provided adjacent the first side of the form downstream from the trailing end of the first feed screw. The second grinding wheel is provided adjacent the second side of the form downstream from a trailing end of the second feed screw. The trailing ends of the first and second feed screws are closer to the discharge end of the form than the leading ends of the third and fourth feed screws. Consequently the strand is moved directly into the leading ends of the third and fourth feed screws by the first and second feed screws. Thus, the strand is smoothly passed from the first and second feed screws to the third and fourth feed screws as the strand is conveyed along the form.

In accordance with another aspect of the present invention, a method of chopping a fiber strand is provided. The method comprises delivering a continuous strand onto a base end of a form, conveying the continuous strand along the form from the base end toward a discharge end and cutting the continuous strand into individual segments of desired length using first and second grinding wheels. In addition the method includes positioning the first and second grinding wheels at opposing sides of the form. Further, the method includes engaging the strands with a strand feeding mechanism as the strand is being cut and dispensing the individual segments from the discharge end of the form following cutting.

The method further includes simultaneously biasing the continuous strand into the strand feeding mechanism and the first and second grinding wheels. The first and second grinding wheels are rotated at speeds of between about 1,000 and about 100,000 rpm. Further the strand is conveyed along the form at a speed of between about 0.01 and about 0.3 m/s. In one possible embodiment, the continuous strand is conveyed along the form in a first direction while the first and second grinding wheels are rotated in a second, opposite direction at both points of contact with the continuous strand. In yet another possible embodiment, the conveying of the continuous strand and the rotating of the grinding wheels are completed in the same direction at both points of contact.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiments of the invention, an example of which is illustrated in the accompanying drawing.

DETAILED DESCRIPTION OF THE PREFERRED EMBODIMENTS OF THE INVENTION

Figure 1:
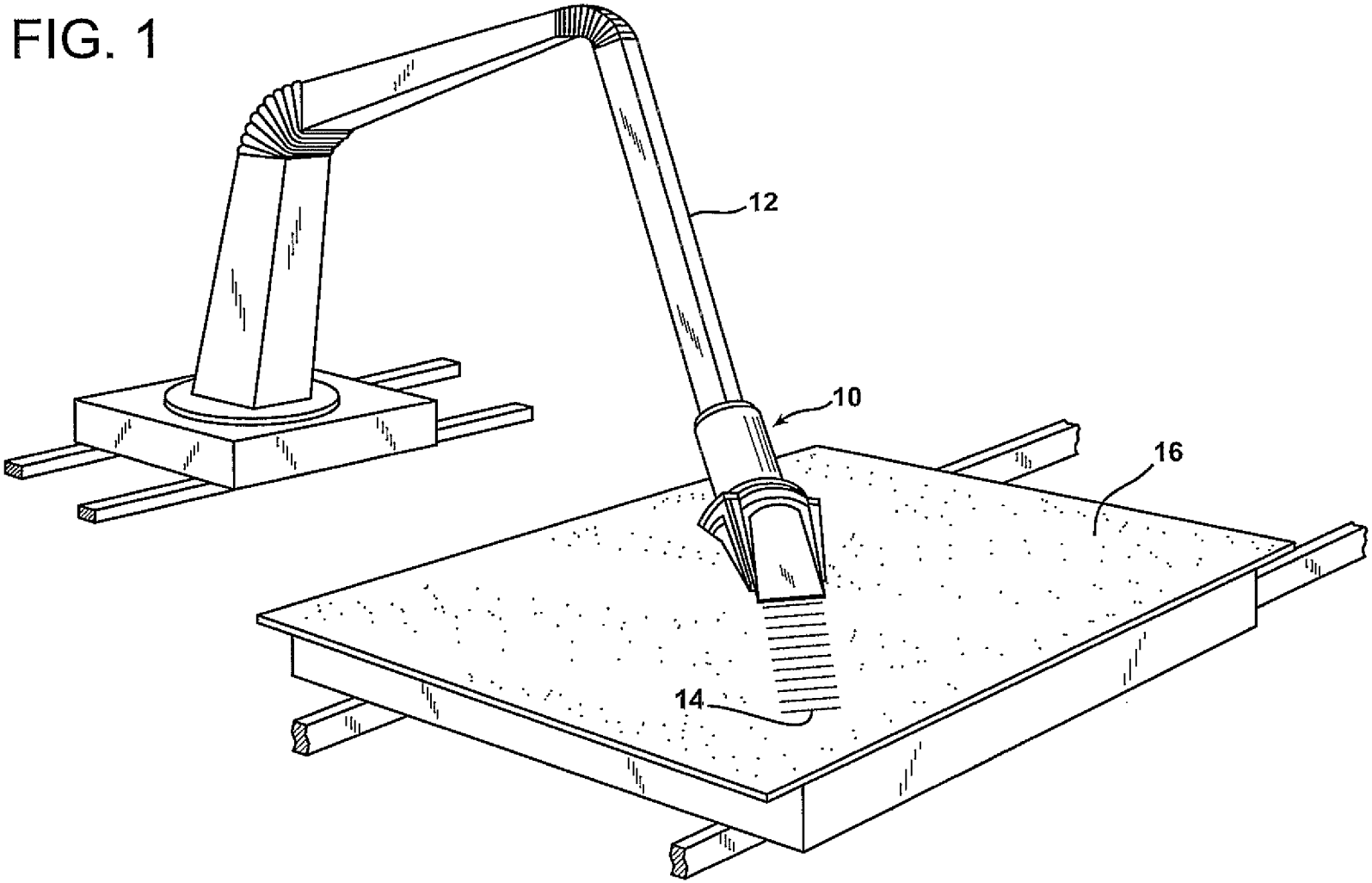
FIG. 1 is a perspective view illustrating a chopping device of the present invention attached to a robot arm, the chopping device depositing chopped fiber segments of desired length onto a collection surface according to the method of the invention.

As illustrated in FIG. 1, a chopping device 10 is attached to a robot arm 12 that is positioned to deposit fiber segments 14 of a discrete/desired length onto a collection surface 16, such as a preform molding surface. Typically the collection surface is a screen. The chopping device 10 need not be robotized or automated and could even be stationary with the collection surface 16 being movable. A source of vacuum (not shown) is usually positioned beneath the screen to facilitate the preform making process. The robot arm 12 can be provided with a hydraulic system (not shown) or other similar system to enable the arm to be positioned adjacent or above a portion of the collection surface 16. The movement of the arm 12 can be controlled by computer (not shown) according to a predetermined pattern so that the desired pattern of fiber segments 14 is laid down on the collection surface 16.

Figure 2:
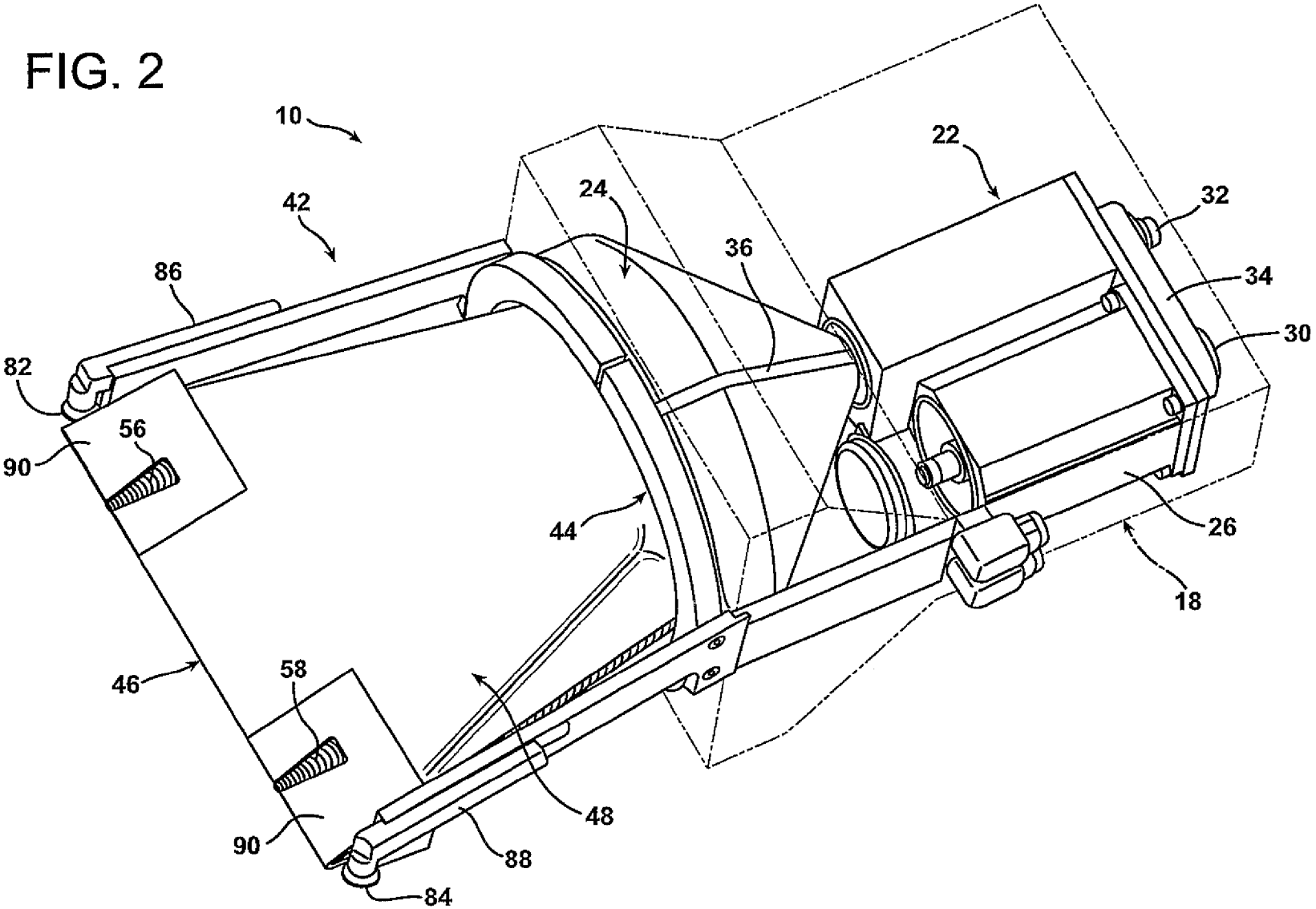
FIG. 2 is a perspective view of the chopping device illustrated in FIG. 1.
Figure 3:
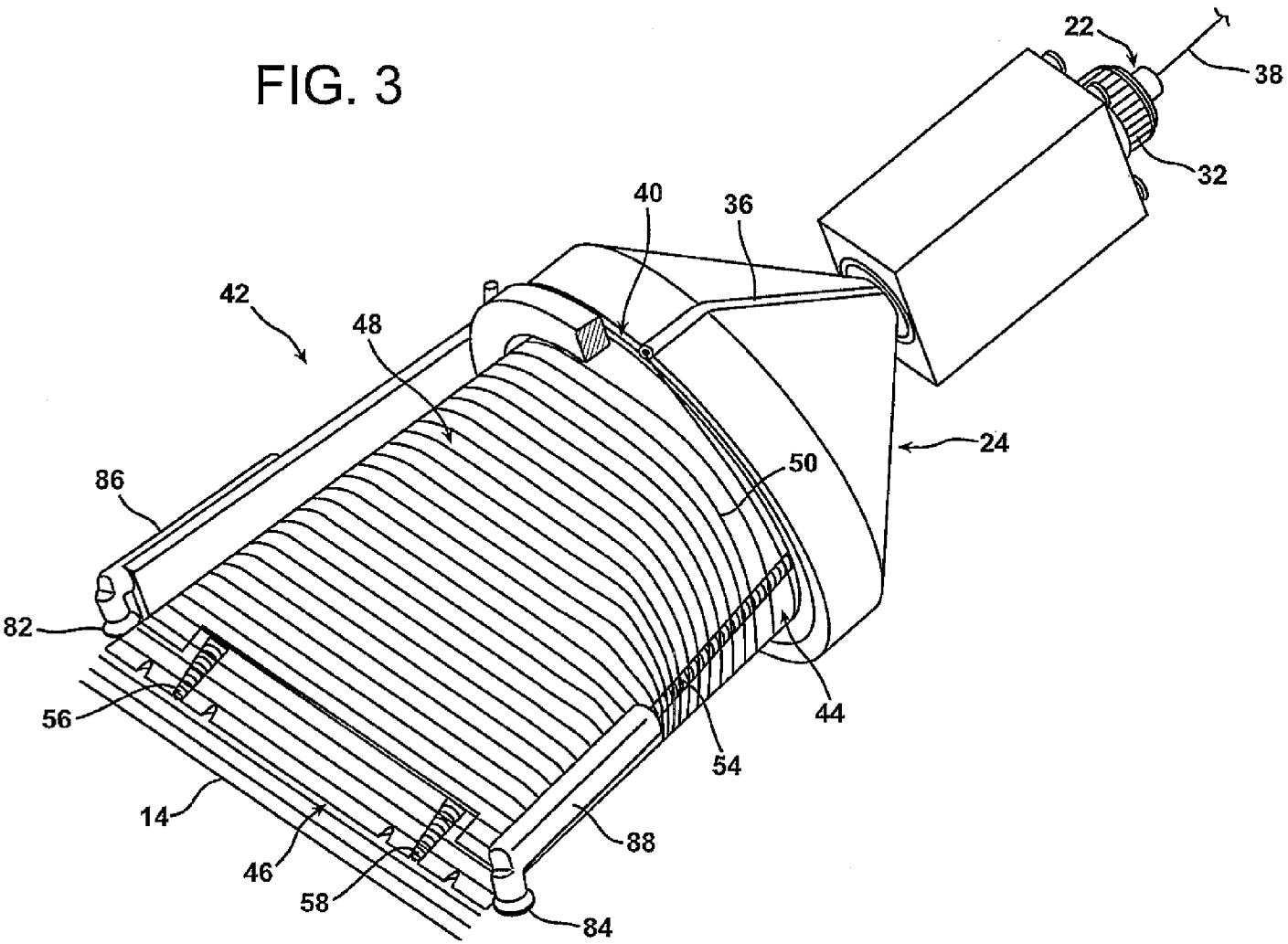
FIG. 3 is a partially fragmentary perspective view of the chopping device illustrated in FIG. 2 showing the feeding of the continuous strand onto the form.
Figure 4:
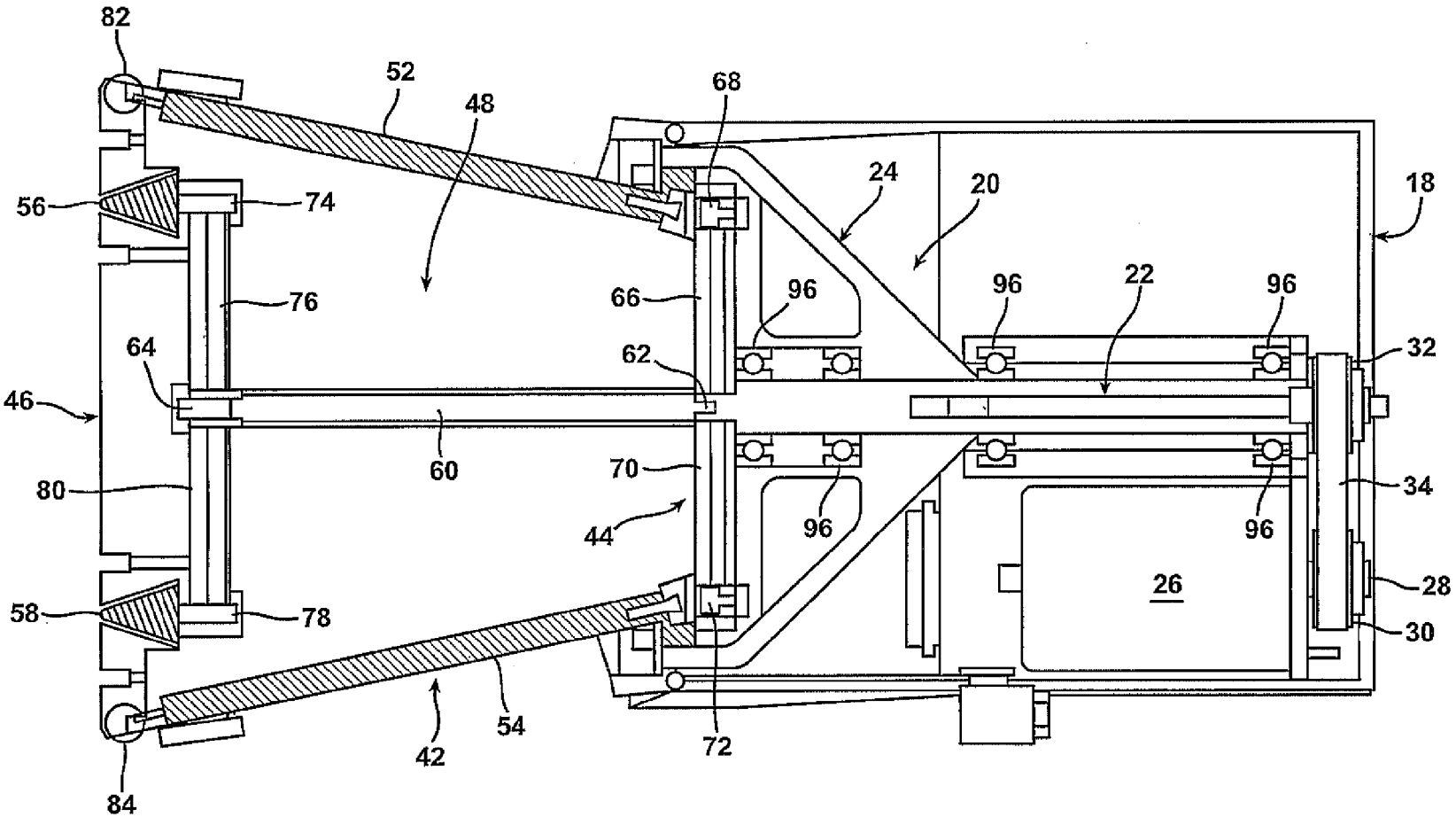
FIG. 4 is a schematical cross sectional view further illustrating the feed screws of the strand feeding mechanism of the chopping device.
Figure 5:
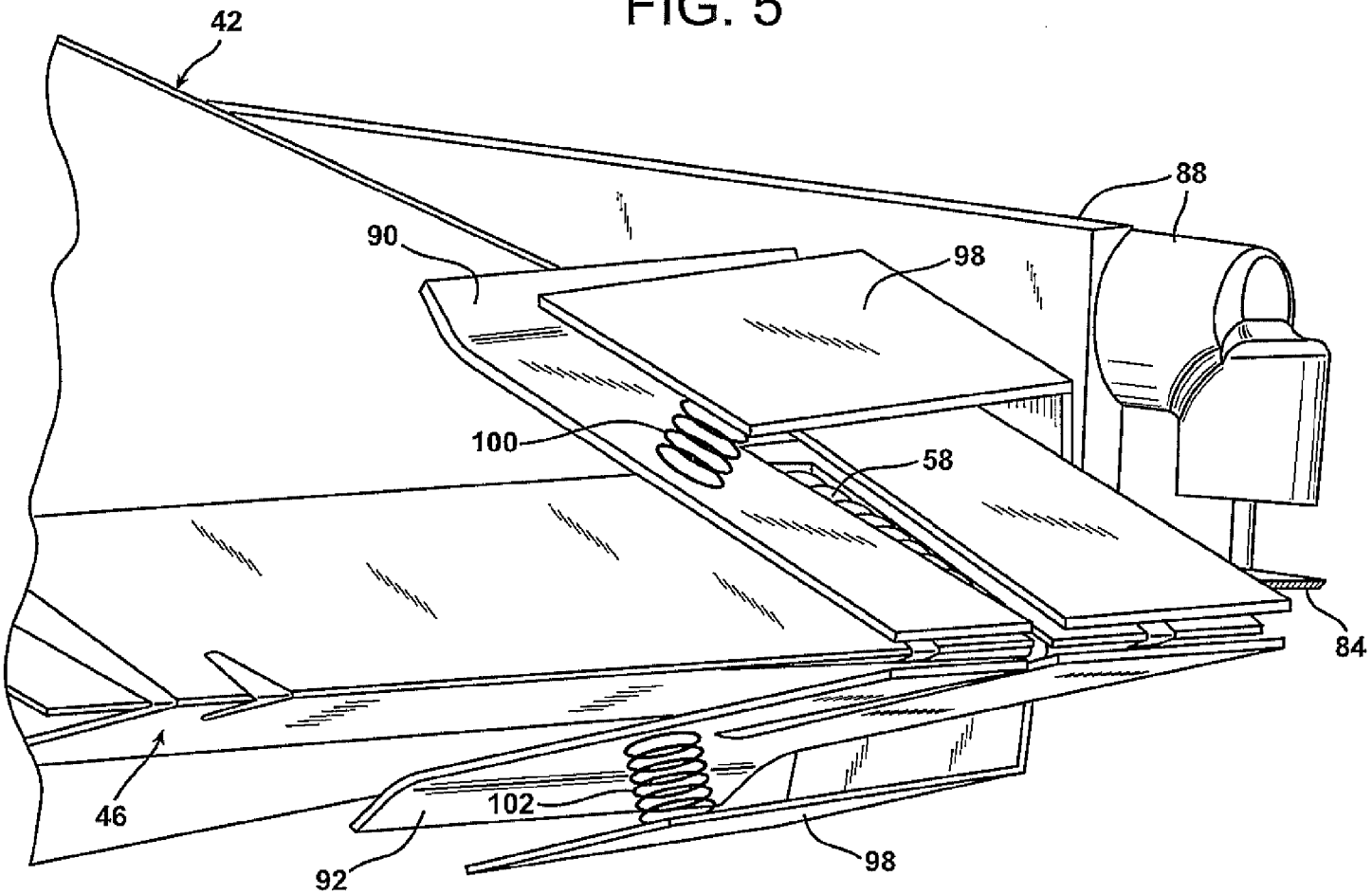
FIG. 5 is a detailed schematical view of the guide plates at one side of the chopping device.

Reference is now made to FIGS. 2-4 illustrating the structure and operation of the chopping device 10 in more detail. The chopping device 10 includes a generally cylindrical outer housing 18. A rotating member or rotor 20 is mounted by means of a series of bearings 96 for rotation within the housing 18. The rotor 20 includes a generally cylindrical input end 22 and a generally conical output end 24. The rotor 20 is rotated by any suitable means, such as a motor 26. As illustrated, motor 26 includes a drive shaft 28. A drive pulley 30 is keyed to the drive shaft 28. A second pulley 32 is keyed to the input end 22 of the rotor 20. A drive belt 34 connects the drive pulley 30 and the driven pulley 32 to rotate the rotor 20.

A feed passage 36 extends longitudinally through the center of the input end 22 and then along an outer surface of the output end 24 of the rotor 20. A continuous reinforcement fiber or strand 38, such as a roving, is supplied from a source (not shown) and is transported to the chopping device 10 through the robot arm 12. The continuous strand 38 is fed through the feed passage 36 of the rotor 20 and then exits through an output opening 40 at the downstream end of the rotor 20.

A form 42 is positioned downstream from the rotor 20. The form 42 includes a base end 44, having a generally circular cross section, and a discharge end 46 comprising a generally elongated linear edge. The terminology "generally circular" means that the ratio of the longest diameter, L, to the shortest diameter, S, is less than 2:1. For example, a perfect circle has an L:S ratio of 1:1. Preferably the base end 44 has a minimum radius (½ the shortest diameter, S) of at least about 15 mm to ensure gentle winding of the continuous strand 38 around the base end 44 of the form 42.

The form 42 includes an elongated intermediate portion 48 between the base end 44 and the discharge end 46. The elongated intermediate portion 48 gradually tapers and becomes progressively flatter and wider from the base end 44 to the discharge end 46. As the rotor 20 is rotated relative to the form 42, the continuous strand 38 is deposited or delivered onto the base end 44 of the form 42 so as to form generally circular loops or coils 50. These loops or coils of strand 50 are then conveyed along the form 42 toward the discharge end 46.

More specifically, in addition to the rotor 20 and motor 26, the strand feeding mechanism includes four feed screws 52, 54, 56, 58. The first feed screw 52 extends along a first side of the form 42. The second feed screw 54 extends along a second opposite side of the form 42. The third and fourth feed screws 56, 58 are provided along the form 42 at the discharge end 46 and at least partially extend between the first and second feed screws 52, 54. The overlap between the first and second feed screws 52, 54 and the third and fourth feed screws 56, 58 insures that the loops or coils of strand 50 are smoothly and efficiently passed from the first and second feed screws to the third and fourth feed screws and movement continues in an uninterrupted manner.

Each of the feed screws 52, 54, 56, 58 is driven through the rotor 20. More specifically, the rotor 20 includes a drive shaft section 60 including two drive gears 62, 64. As best illustrated in FIG. 4, drive gear 62 meshes with gear set 66 which in turn meshes with gear 68 which is connected through a universal joint to the first feed screw 52. Similarly, drive gear 62 meshes with gear set 70 which in turn meshes with gear 62 that is connected through a universal joint to the second feed screw 54.

Drive gear 64 at the distal end of the rotor 20 drives the gear 74 connected to the third feed screw 56 through the gear set 76. Further, the drive gear 64 drives the gear 78 on the fourth feed screw 58 through the gear set 80.

As noted above, as the rotor 20 is rotated by the motor 26, the continuous strand 38 is laid out in loops or coils 50 on the base end 44 of the form 42. As each new loop or coil 50 is delivered, it is engaged by the first and second feed screws 52, 54 at the leading end of those screws. Each loop or coil 50 is then advanced by the first and second feed screws 52, 54 along the form 42. As the form 42 gradually tapers and becomes progressively flatter and wider from the base end 44 to the discharge end 46, the loops or coils 50 being advanced follow the contour of the form 42 and also become progressively flatter and wider. As each loop or coil 50 approaches the trailing ends of the first and second feed screws 52, 54 adjacent the discharge end 46 of the form 42, the loops are also engaged by the leading ends of the third and fourth feed screws 56, 58 provided between the trailing ends of the first and second feed screws 52, 54. The third and fourth feed screws 56, 58 continue to advance or convey the loops 50 toward the discharge end 46 of the form 42.

First and second grinding wheels 82, 84 are provided adjacent and just downstream from the trailing ends of the first and second feed screws 52, 54 at the first and second sides of the form 42 adjacent the discharge end 46. Grinding wheel 82 is rotated by a motor 86 while grinding wheel 84 is rotated by a motor 88. Each of the grinding wheels 82, 84 has a grinding face having a width of between about 0.1 and about 3 mm.

A series of guide plates 90, 92 are provided over the form 42 adjacent the third and fourth feed screws 56, 58. The guide plates 90, 92 are secured to the adjacent housing of the motor 88 by means of a substantially U-shaped support bracket 98. A first compression spring 100 extends between the support bracket 98 and the guide plate 90. A second compression spring 102 extends between the support bracket 98 and the guide plate 92. Together, the compression springs 100, 102 bias the guide plates 90, 92 toward the form 42. As a consequence, the guide plates 90, 92 help guide the loops or coils of strand 50 into the third and fourth feed screws 56, 58 while simultaneously biasing the loops or coils of strand toward the first and second grinding wheels 82, 84. As the loops or coils of strand 50 are conveyed to the discharge end 46 of the form 42, they are cut by the grinding wheels 82, 84 into individual segments of fiber 14 of desired length and are almost immediately discharged from the discharge end 46 of the chopping device 10 by the third and fourth feed screws 56, 58. Since the individual fiber segments 14 are discharged almost immediately upon cutting, they are discharged in an orderly and parallel fashion. Advantageously this helps insure that the fiber segments are dispersed in the desired position and in the desired orientation.

Summarizing the operation of the chopping device 10, the method of chopping a fiber strand comprises delivering a continuous strand 38 onto a base end 44 of a form 42. Next is the conveying of the continuous strand 38, in the form of loops or coils 50, along the form 42 from the base end 44 toward a discharge end 46. This is followed by the cutting of the continuous strand, again in the form of loops or coils 50, into individual segments of fibers 14 of desired length using first and second grinding wheels 82, 84. The first and second grinding wheels 82, 84 are positioned at opposing sides of the form 42. During the chopping process the strand 38, 50 is engaged with a strand feeding mechanism including rotor 20 and the first, second, third and fourth feed screws 52, 54, 56, 58. The method also includes the step of simultaneously biasing the continuous strand into the strand feeding mechanism and the first and second grinding wheels 82, 84 by means of the guide plates 90, 92.

Typically, the first and second grinding wheels 82, 84 are rotated by the motors 86, 88 at a speed of between about 1,000 and about 100,000 rpm and have a diameter of between about 5 and about 120 mm. Further, the continuous strand, in the form of loops or coils 50, is typically conveyed along the form 42 at a speed of between about 0.01 and about 0.3 m/s. The grinding wheels 82, 84 may be rotated so that they are moving in the same direction as the strand is moving along the form at the point of contact with the strand or in a direction opposite to the direction of movement of the strand.

In some embodiments of the invention, certain features of the invention may used to advantage without a corresponding use of other features.

Figure 6:
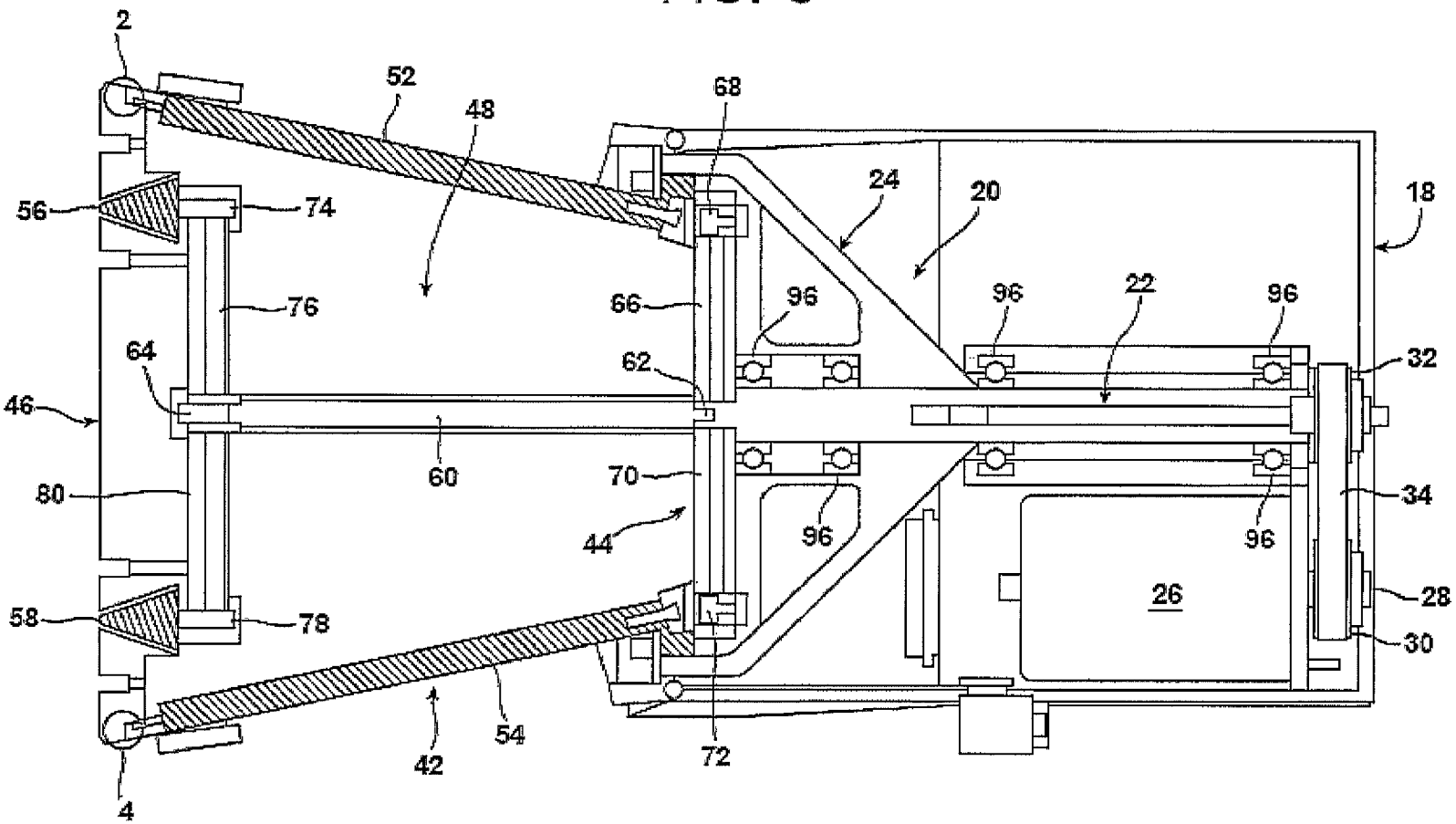
FIG. 6 is a schematical cross sectional view further illustrating the feed screws of the strand feeding mechanism of the chopping device according to another exemplary embodiment.

For example, in certain applications such as the exemplary embodiment shown in FIG. 6, a pair of rotating knives 2, 4 may be used instead of grinding wheels 82, 84 to cut continuous strand 38. Suitable rotating knives are described in U.S. Pat. No. 6,038,949, the text of which is incorporated herein by reference as though fully set forth.

Figure 7:
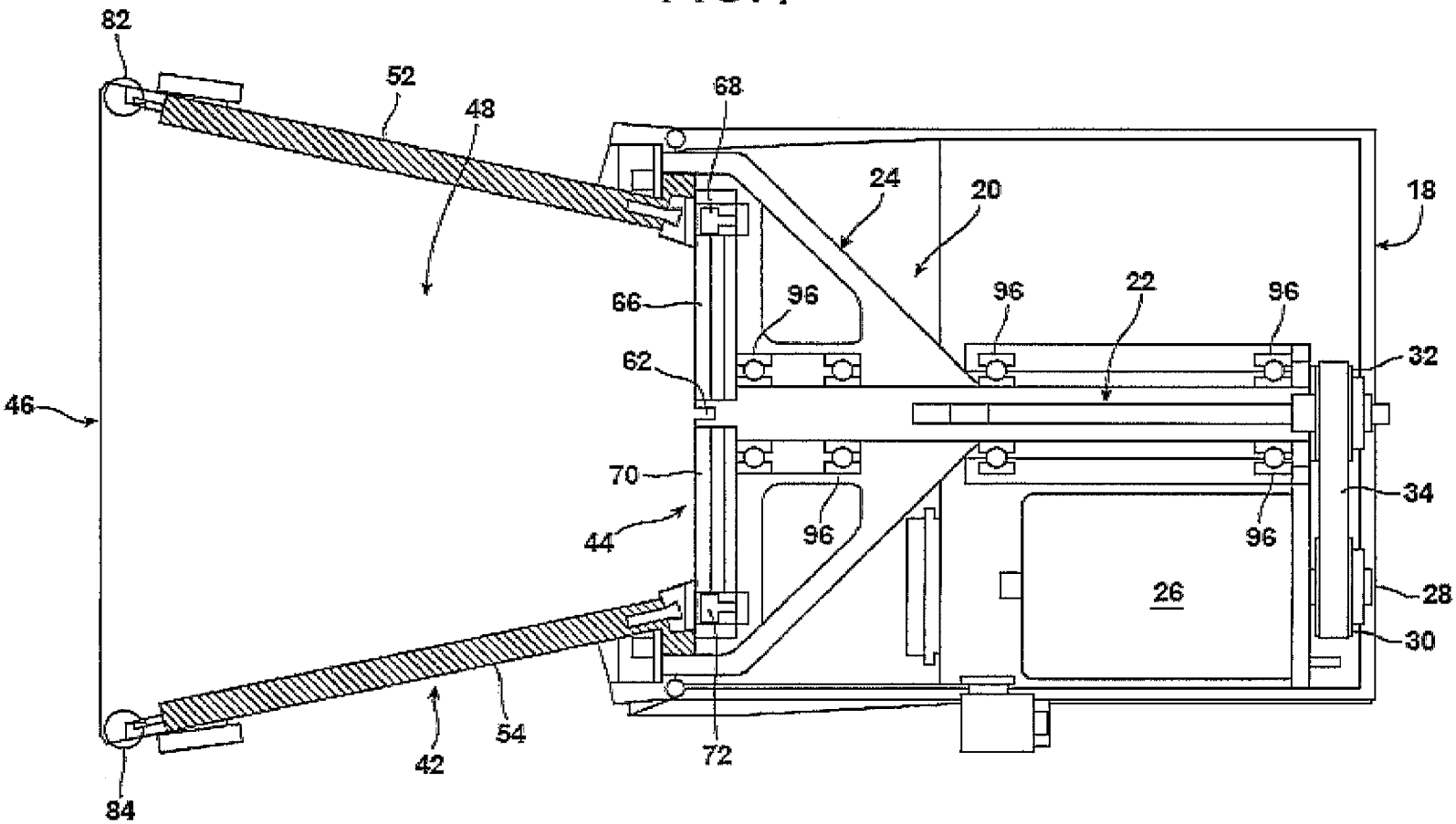
FIG. 7 is a schematical cross sectional view further illustrating a chopping device according to yet another exemplary embodiment.

In other applications, such as the exemplary embodiment shown in FIG. 7, third and fourth feed screws 56, 58 may not be needed. In this latter embodiment, only first and second feed screws 52, 54 are driven through the rotor 20.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

The invention claimed is:

1. A device for chopping fiber strand, the device comprising:

a form including a base end and a discharge end; and a strand feeding mechanism that delivers said strand to said form and conveys said strand along said form, said strand feeding mechanism including a first feed screw provided along a first side of said form and a second feed screw provided along a second opposite side of said form;

wherein said device further includes third and fourth feed screws, said third and fourth feed screws being provided along said form at least partially between said first and second feed screws at said discharge end; and wherein said device further includes means for cutting said strand into individual fiber segments of desired length as said strand is conveyed along said form.

2. A device according to claim 1, wherein said means for cutting includes first and second rotating knives.

3. A device according to claim 1, wherein trailing ends of said first and second feed screws are closer to said discharge end of the form than leading ends of said third and fourth feed screws, whereby said strand is movable directly into said leading ends of said third and fourth feed screws by said first and second feed screws.

4. A device according to claim 1, further including guide plates and compression springs that bias said guide plates toward said form, said guide plates operable to guide loops or coils of strand into said third and fourth feed screws.

5. A device according to claim 1, wherein said means for cutting includes first and second grinding wheels.

6. A device according to claim 5, wherein said first grinding wheel is provided adjacent said first side of said form downstream from a trailing end of said first feed screw and said second grinding wheel is provided adjacent said second side of said form downstream from a trailing end of said second feed screw.

7. A device according to claim 5, further including guide plates and compression springs that bias said guide plates toward said form, said guide plates operable to guide loops or coils of strand into said third and fourth feed screws and bias said strand toward said first and second grinding wheels.

8. A device for chopping fiber strand, the device comprising:

a form including a base end having a generally circular cross section and a discharge end comprising an elongated linear edge; and a strand feeding mechanism that delivers said strand to said form and conveys said strand along said form, said strand feeding mechanism including a first feed screw provided along a first side of said form and a second feed screw provided along a second opposite side of said form;

wherein the device further includes first and second grinding wheels operable to cut said strand into individual segments of desired length as said strand is conveyed along said form.

9. A device according to claim 8, wherein said first and second grinding wheels are positioned adjacent said discharge end of said form.

10. A device according to claim 8, wherein said first grinding wheel is provided adjacent said first side of said form downstream from a trailing end of said first feed screw, and wherein said second grinding wheel is provided adjacent said second side of said form downstream from a trailing end of said second feed screw.

11. A device according to claim 8, wherein said first and second grinding wheels each have a diameter of between 5 and 120 mm and are capable of rotating at a speed of between 1,000 and 100,000 rpm.

12. A device according to claim 8, further including guide plates and compression springs operable to bias said strand toward said first and second grinding wheels.

13. A method of chopping a fiber strand, the method comprising:

delivering a loop of continuous strand onto a base end of a form;

conveying said loop along said form from said base end toward a discharge end by engaging said loop with first and second feed screws;

engaging said loop with third and fourth feed screws positioned between said first and second feed screws at said discharge end;

cutting said loop into individual fiber segments of desired length;

conveying said individual fiber segments toward said discharge end with said third and fourth feed screws; and discharging said individual fiber segments.

14. A method according to claim 13, wherein said loop of continuous strand is conveyed along said form at a speed of between 0.01 and 0.3 m/s.

15. A method according claim 13, wherein the cutting step includes using first and second grinding wheels positioned at opposing sides of said form and adjacent said discharge end of said form to cut said loop.

16. A method of chopping a fiber strand, the method comprising:

delivering a continuous strand onto a base end of a form;

conveying said continuous strand along said form from said base end toward a discharge end;

cutting said continuous strand into individual fiber segments of desired length using first and second grinding wheels; and discharging said individual fiber segments.

17. A method according to claim 16, wherein the cutting step includes positioning said first and second grinding wheels at opposing sides of said form and adjacent said discharge end of said form.

18. A method according to claim 16, wherein the cutting step includes rotating said first and second grinding wheels at a speed of between 1,000 and 100,000 rpm.

19. A method according to claim 16, wherein the conveying step includes conveying said continuous strand along said form in a first direction and rotating said first and second grinding wheels in a second, opposite direction at both points of contact with said continuous strand.

20. A method according to claim 16, further including conveying said continuous strand along said form and rotating said first and second grinding wheels at both points of contact with said continuous strand in the same direction.

* * * * *